United States Patent [19]

Drummond et al.

[11] Patent Number: 4,541,494

[45] Date of Patent: Sep. 17, 1985

[54] DRILL BIT ASSEMBLY

[75] Inventors: Donald D. Drummond, Jasper; Walter F. Johnsey; Roy W. Wood, both of Birmingham, all of Ala.

[73] Assignee: Drumco, Jasper, Ala.

[21] Appl. No.: 435,239

[22] Filed: Oct. 19, 1982

[51] Int. Cl.[4] ..... E21B 10/24

[52] U.S. Cl. ..... 175/228; 175/331; 175/324

[58] Field of Search ..... 175/228, 71, 337, 324

[56] References Cited

U.S. PATENT DOCUMENTS

| | | | |
|---|---|---|---|
| 2,634,101 | 4/1953 | Sloan | 175/324 |
| 2,814,464 | 11/1957 | Pike et al. | 175/337 |
| 2,920,872 | 1/1960 | Baur et al. | 255/24 |
| 3,029,881 | 4/1962 | Swart | 175/228 |
| 3,037,264 | 6/1962 | Mossberg | 29/106 |
| 3,048,230 | 8/1962 | Angel | 175/228 |
| 3,125,175 | 3/1964 | Medlock et al. | 175/228 |
| 3,169,587 | 2/1965 | Hubbard | 175/71 |
| 3,199,382 | 8/1965 | Andreasson | 77/72 |
| 3,359,837 | 12/1967 | Andreasson | 77/68 |
| 3,370,489 | 2/1968 | Andreasson | 77/72 |
| 3,511,120 | 5/1970 | Kaser | 77/68 |
| 3,543,613 | 12/1970 | Obloy | 77/72 |
| 3,561,299 | 2/1971 | Brisk et al. | 77/55 |
| 3,597,817 | 8/1971 | Whalley | 29/106 |
| 3,798,725 | 3/1974 | Hanson | 29/106 |
| 4,080,091 | 3/1978 | Hollingshead | 408/60 |
| 4,168,925 | 9/1979 | Dufresne | 408/59 |
| 4,194,567 | 3/1980 | Marais | 175/71 |
| 4,375,242 | 3/1983 | Galle | 175/228 |

*Primary Examiner*—Stephen I. Novosad
*Assistant Examiner*—Hoang C. Dang
*Attorney, Agent, or Firm*—Dann, Dorfman, Herrell and Skillman

[57] ABSTRACT

A drill bit assembly for a rotary drill having a source of fluid under pressure and three bearing mounted rotary cutting cones for drilling into relatively hard material comprises an elongated housing with a first end adapted for engagement with the drill and a second end including the cutting cones or tools for engagement with the material to be drilled. A plenum chamber is provided within the housing for receiving pressurized fluid and for dividing the pressurized fluid into three portions. A first portion of the pressurized fluid is directed downwardly for impringement upon the material being drilled to pick up and remove dust and cuttings from the vicinity of the cutting cones. A second flow of the pressurized fluid is directed upwardly to remove the dust and cutting cones from the drill hole. The third flow of fluid is directed through the cutting cone bearings to cool the bearings during the drilling operation. Storage means is also provided within the housing for receiving and storing a supply of lubricating fluid, the lubricating fluid flowing through a distribution conduit to the cutting cone bearings for lubrication thereof.

29 Claims, 4 Drawing Figures

DRILL BIT ASSEMBLY

BACKGROUND OF THE INVENTION

The present invention relates generally to drill bits and, more particularly, to such a bit having a plurality of rotary cutting cones for use with a rotary drill for drilling into a relatively hard material, such as rock and the like.

DESCRIPTION OF THE PRIOR ART

Typical prior art rotary drill bit assemblies used for drilling into rock or other such relatively hard material comprise an elongated generally tubular housing or adapter sub to which is attached a drill bit which include a plurality (generally three) of bearing mounted rotary cutting cones on the lower end thereof. The upper end of the adapter sub is adapted to engage for rotation a rotary drill, either directly or through the use of a suitable extension pipe when drilling deep holes. The adapter sub includes a central conduit which extends from the rotary drill (or the extension pipe) to the vicinity of the cutting cones. Pressurized air from the rotary drill flows (either directly or via the extension pipe) through the central conduit and is discharged downwardly through jet nozzles positioned between the cutting cones. The expanding air discharged from the jet nozzles impinges upon the rock or other material being drilled and acts as a scavenging medium to pick up dust and cuttings and carries them upwardly past the cutting cones and out of the drill hole. Water or other such wetting agents may be added to the air flow continuously or intermittently as required to help control the dust generated by the drilling operation. A portion of the air flow may also be circulated by a second conduit through the cutting cone bearings to cool the bearings and to help prevent the entry of extraneous material into the bearings.

While the above-described prior art drill bit assemblies are relatively effective for drilling holes in rock and other such relatively hard materials, they suffer from certain operational drawbacks. It has been found that the high velocity air discharged from the jet nozzles reacts with the highly abrasive cuttings and dust from the bottom of the drill hole to, in effect, sandblast the cutting cones, thereby providing excessive wear and decreasing their useful service life. In addition, the prior art system of passing a cooling air flow through the cutting cone bearing adversely affects the lubrication of the bearings, thereby resulting in premature bearing wear and failure. Furthermore, during those periods of time when water is added to the air flow to control the release of dust, the water is also carried by the air into the cutting cone bearings, resulting in excessive corrosion and accelerated bearing wear.

All of the above-described drawbacks of the prior art drill bit assemblies overcome or substantially reduced by the present invention which is effective to provide for an improved, longer service life bit by dividing the air flow in the adapter sub into three portions to provide a first downwardly directed flow of air to pick up and remove dust and cuttings from the vicinity of the cutting cones, a second upwardly directed flow of fluid to scavenge the dust and cuttings away from the adapter sub and out of the drill hole and a third flow of dry fluid for picking up and conveying oil to the cutting cone bearings to both cool and lubricate the bearings.

SUMMARY OF THE INVENTION

Briely stated, the present invention provides a bit assembley for a rotary drill having, a source of fluid under pressure. The bit assembly has at least one rotary cutting cone for drilling into a relatively hard material, such as rock. The bit assembly comprises an elongated housing having a first end adapted for engagement with the drill and a second end, including the cutting cone, for engaging the material to be drilled. A plenum chamber is located within the housing for receiving a supply of pressurized fluid flowing from the fluid source and for maintaining the received fluid at a first predetermined pressure. A first conduit means is provided within the housing for receiving a first flow of fluid from the plenum chamber and for directing the first fluid flow out of the housing for impingement upon the material to pick up and remove dust and cuttings from the vicinity of the cutting cone. A second conduit means is provided within the housing for receiving a second flow of fluid from the plenum chamber and for directing the second fluid flow out of the housing in the reverse direction toward the first end of the housing, the second fluid flow being effective as a scavenger flow to convey the dust and cuttings removed from the vicinity of the cutting cone by the first fluid flow away from the bit assembly and out of the drill hole.

BRIEF DESCRIPTION OF THE DRAWINGS

The foregoing summary, as well as the following detailed description of the preferred embodiment of the present invention, will be better understood when read in conjunction with the accompanying drawings, in which.

DESCRIPTION OF A PREFERRED EMBODIMENT

Figure 2:
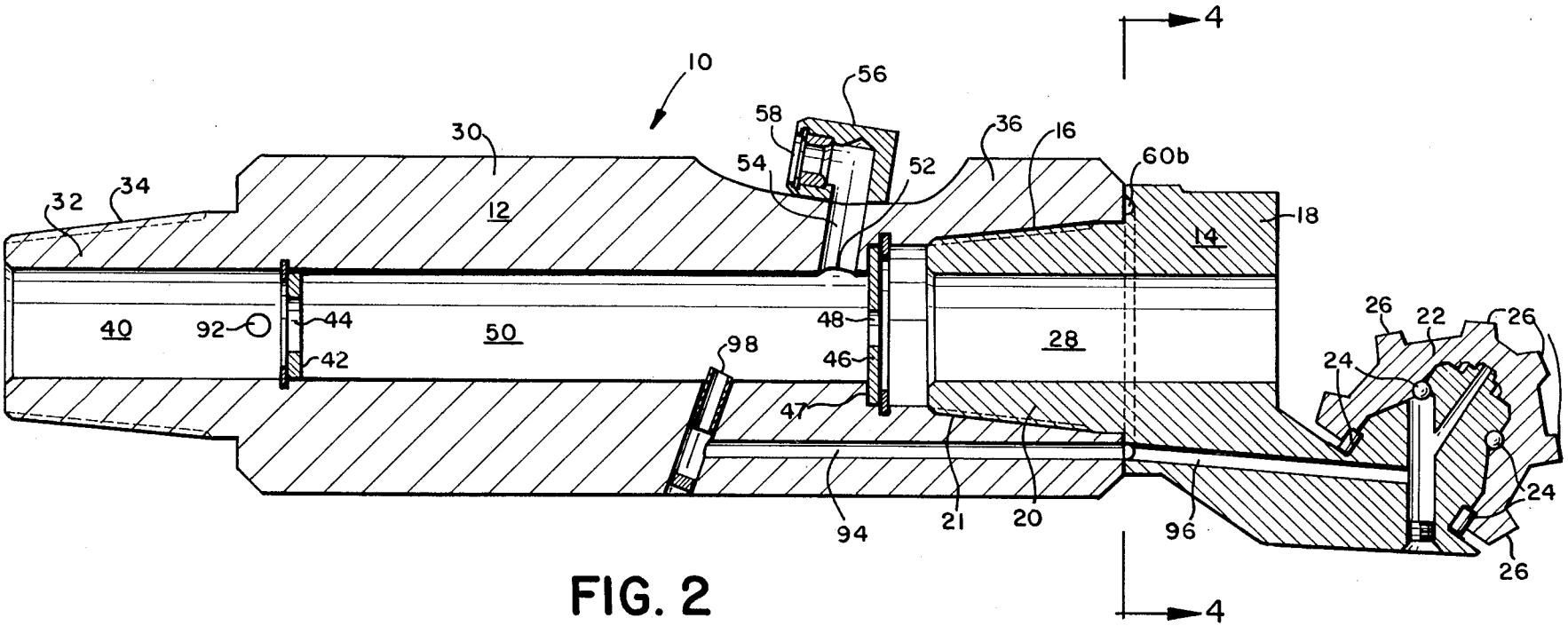
FIG. 2 is a sectional view of FIG. 1 taken along the irregular section line 2—2 of FIG. 1.

Referring to the drawings, and particularly to FIG. 2, there is shown a sectional, view of a preferred embodiment of a drill bit assembly, generally designated 10, in accordance with the present invention. A drill bit assembly of the type shown may be used in conjunction with a standard rotary drill (not shown) for drilling into relatively hard material, such as rock or the like (not shown) and has found particular application in connection with coal mining.

The drill bit assembly 10 is generally comprised of two major sub-assembly; an adapter subassembly 12 and a drill bit 14. The drill bit 14 comprises an irregularly shaped housing 18 having a frustoconically-shaped nipple 20 for engaging a complementary sized and shaped tapered socket 21 on the adapter sub 12 as shown. The nipple and socket are threaded as indicated at 16 to releasably secure the adapter sub 12 and the drill bit 14 to form a complete drill bit assembly 10.

The drill bit housing 18 is adapted to rotatably support three rotary cutters or cutting cones 22 (only one of which is shown on FIG. 2 for purposes of clarity). The cutting cones 22 are each journalled for independent rotation upon bearings 24 which, in the present embodiment, comprise suitable anti-friction bearings. Suitable sealing means (not shown) may be provided to prevent debris from entering the area between the cutting cones 22 and the underlying supporting housing 18 and from contacting the bearings 24. The exterior surface of each of the cutting cones 22 may include a plurality of cutting teeth 26 which are employed for cutting into rock and other, hard materials upon rotation of the drill bit assembly 10 during the drilling operation. The teeth 26, as well as the other components of the cutting cones 22 are generally comprised of (or at least faced with) a relatively hard material such as tungsten carbide or the like. For purposes which will hereinafter become apparent, the drill bit housing 18 includes a generally cylindrically-shaped open conduit 28 extending centrally thereof from the end nipple 20 to the vicinity of the cutting cones 22.

Drill bits of the general type shown and described are well known in the art and may be purchased commercially in various configurations from several bit manufacturing companies. A more complete description of the detailed structure and operation of the conventional drill bit may be obtained from the manufacturer, if desired.

The adapter sub 12 is comprised of a generally cylindrically-shaped elongated housing 30 having a first frustoconically shaped drill end 32. The drill end 32 of the housing may include suitable threading 34 and is adapted for engagement with a rotary drill (not shown). The adapter sub 12 may be connected to the rotary drill (not shown), either directly or through the use of a suitable extension pipe (not shown) when drilling deeper holes which are beyond the normal reach of a standard rotary drill.

As discussed briefly above, the second or tool end 36 of the adapter sub housing 30 includes a suitably tapered threaded socket 21 for engaging and retaining the drill bit 14 as shown.

The adapter sub housing 30 includes a generally cylindrical open bore or passageway 40 which extends longitudinally through the center of the housing 30 from the first end 32 along the entire length to the second end 36. During the drilling operation, the bore 40 receives pressurized fluid or air from a supply source of air under pressure (not shown) which is maintained within or located adjacent to the rotary drill (not shown). (If an extension pipe is required, the pressurized air is supplied from the rotary drill through the extension pipe to the bore 40.) The pressurized air enters the bore 40 at the first housing end 32. The received air is thereafter distributed in a manner which will hereinafter be described in detail.

A first generally annular orifice plate 42 having a first generally circular orifice or opening 44 extending therethrough is mounted within the bore 40 near the first housing end 32 as shown. A second generally annular orifice plate 46 having a second generally circular orifice or opening 48 is mounted as shown against an annular shoulder 47 within the bore 40 proximate the second housing end 36. The two annular orifice plates 42 and 46 and their respective openings 44 and 48 cooperate with the generally cylindrical bore 40 to form a plenum chamber 50 within the adapter sub housing 30.

During the drilling operation, pressurized air from the rotary drill initially enters the plenum chamber 50 through first circular opening 44. By controlling the size of the circular opening 44, the flow and the pressure of the supplied air within the plenum chamber 50 can be maintained at a predetermined generally constant pressure which is slightly less than the supply pressure. The circular opening 44 acts generally as a restrictor means to establish a desired pressure differential across the orifice plate 42. For example, if the air from the rotary drill enters the passageway 40 at a pressure of 60 pounds per square inch, the circular opening 44 allows the plenum chamber 50 a pressure on the order of 55 pounds per square inch.

Orifice plate 46 and circular opening 48 function in substantially the same manner to reduce the pressure of the air exiting the plenum chamber 50 through the circular opening 48. In the above-discussed example, if the pressure within the plenum chamber 50 is maintained at about 55 pounds per square inch, the circular opening 48 allows the air exiting the plenum chamber 50 to assume a pressure on the order of 45–50 pounds per square inch.

The air exiting the plenum chamber 50 through circular opening 48 comprises a first air flow which enters the drill bit conduit 28 and, as in the prior art drill bits, is directed downwardly (toward the right on FIG. 2) and discharged between the cutting cones 22 for impingement upon the material being drilled. The purpose of the first air flow exiting from the plenum chamber 50 is to cool the surface of the cutting cones 22 and to serve as a circulating medium to pick up and exhaust or remove dust and material cuttings from the drill hole in the vicinity of the cutting cones 22. The force of the first air flow serves to convey the cuttings and dust upwardly past the cutting cones 22 and around the outer surface of the drill bit assembly 10.

As discussed briefly above, in the prior art drill bits, substantially all of the air from the rotary drill passed at an unreduced pressure through the drill bit and impinged directly upon the material being drilled for the removal of dust and cuttings. It was the high pressure flow of substantially all of the compressed air in this manner which led to the sandblasting effect which caused premature wear of the cutting cones on the prior art drill bits. With the present invention, only a portion of the air from the plenum chamber 50 is directed to impinge upon the material being drilled for the removal of the dust and cuttings in the vicinity of the cutting cones 22 and that air flow is at a reduced quantity and velocity. By reduc:ng the pressure of the air impinging upon the material, the potential for damage to the cutting cones 22 caused by the sandblasting effect of the highly abrasive cuttings and dust is greatly reduced from that of the prior art. As discussed below, the first air flow out of the plenum chamber 50 need only be high enough in quantity and velocity to exhaust the dust and cuttings from around the cutting cones 22 and a short distance upwardly (toward the left in FIG. 2), to be picked up by a second flow, as described hereinafter.

Figure 1:
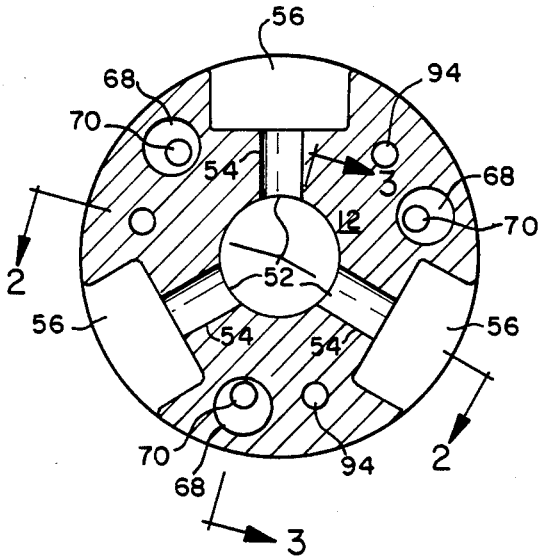
FIG. 1 is a transverse sectional view of a preferred embodiment of the drill bit assembly of the present invention.

As shown in FIGS. 1 and 2, three generally circular openings 52 are disposed generally equidistantly from each other around the circumference of the plenum chamber 50 proximate to the annular orfice plate 46. The circular openings 52 extend radially outwardly through the adapter sub housing 30 to form second generally cylindrical conduit means 54. The conduit means 54 provide fluid communication between the plenum chamber 50 and three corresponding jet nozzle assemblies 56. As shown in FIG. 2, the jet nozzle assemblies 56 (only one nozzle assembly is shown for clarity) are mounted on the outer surface of the adapter sub housing 30 and are oriented upwardly with their nozzle orifices 58 pointing toward the first or drill end 32 of the housing (toward the left when viewing FIG. 2). Air from the plenum chamber 50 is directed through the second conduit means 54, through the jet nozzle assemblies 56 and out of the jet nozzle orifices 56 toward the first drill end of the housing. During the drilling operation, the flow of air exiting from the jet nozzle orifices 58 operates as a scavenging flow and picks up or combines with the above-described first air flow out of the plenum chamber 50 for further conveying the dust and cuttings removed from the vicinity of the cutting cones upwardly and out of the drill hole. By, in effect, splitting the flow of air from the plenum chamber 50 in this manner, the abrasive dust and cuttings are efficiently conveyed away from the drill bit assembly 10 and out of the drill hole with a significant decrease in the sandblasting effect encountered by the cutting cones 22.

Figure 4:
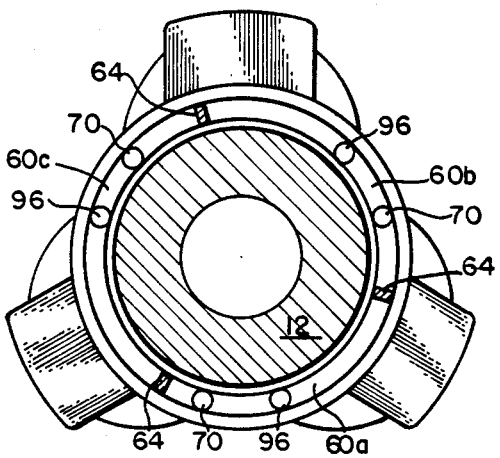
FIG. 4 is a sectional view of the oil reservoir portion taken along line 4—4 of FIG. 2.
Figure 3:
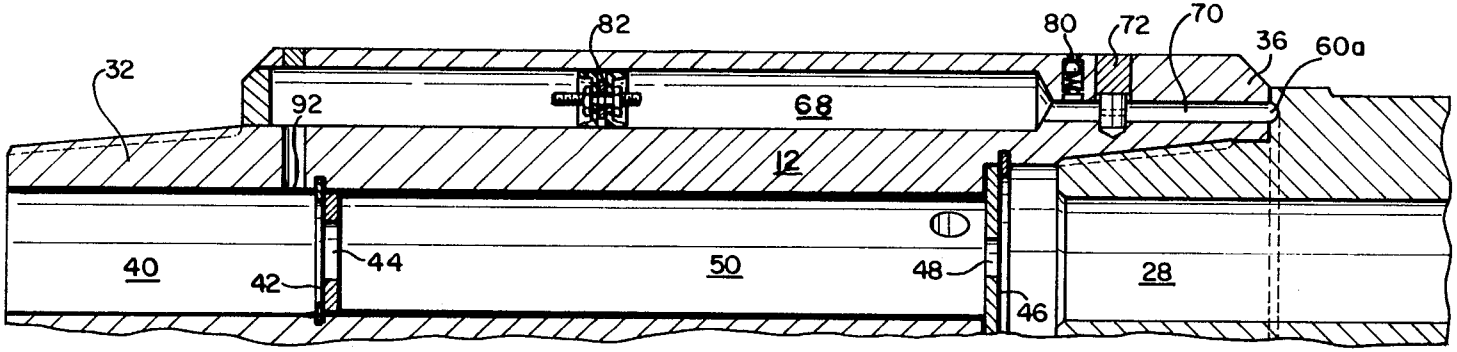
FIG 3 is a partial sectional view of the adapter sub portion of FIG. 1 taken along line 3—3 of FIG. 1.

The drill bit assembly 10 also includes provisions for cooling and lubricating the cutting cone bearings 24. Referring now to FIGS. 2, 3 and 4, at the base of the nipple portion 20 the adapter sub housing 30 further includes an annular lubricating fluid reservoir 60 comprised of an annular conduit or groove cut within the drill bit housing 18 and confronting the tool end 36 of the adapter sub housing. For purposes which will hereinafter become apparent, the annular reservoir 60 may be divided by suitable partition means 64 into a plurality of arcuate reservoir segments which, in the illustrated embodiment of FIG. 4, comprise three segments 60*a*, 60*b* and 60*c*. Each of the reservoir segments 60*a*, 60*b* and 60*c* may be used to store and distribute an individual supply of cooling and lubricating fluid for each of the cutting cones 22. To this end, means is provided to mix lubricating fluid, e.g., oil, into a flow of cooling fluid, e.g., air, passing through the reservoir into the interior of the cutting cones 22.

Pressure-actuated storage means is provided for injecting and maintaining a supply of lubricating fluid, such as oil, into each cf the three reservoir segments 60*a*, 60*b* and 60*c*. For the sake of clarity in the present application, only one such storage means will be described in connection with FIG. 3, it being apparent that two additional such means are also included as a part of the present embodiment. The storage means hereinafter described provides a flow of lubricating fluid to reservoir segment 60*a* for eventual lubrication of the cutting cone bearings 24.

Referring now to FIG. 3, it can be seen that the means for providing a flow of lubricating fluid to reservoir segment 60*a* generally comprises an elongated cylindrical lubricating fluid storage cavity 68 extending lengthwise within the adapter sub housing 30. A generally cylindrical supply conduit 70 provides fluid communication between the storage cavity 68 and reservoir segment 60*a*. As shown, the diameter of the supply conduit 70 may be somewhat smaller than the diameter of the storage cavity 68, it being understood that the supply conduit 70 need only be as large as is necessary in order to maintain a desire amount of lubricating fluid within reservoir segment 60*a*.

A metering valve 72 is provided in order to further control and limit the rate of lubricating fluid which flows from the storage cavity 68 to reservoir segment 60*a*. As shown, the metering valve 72 restricts the flow of lubricating fluid from the storage cavity 68 to reservoir segment 60*a*, and is adjustable so that the flow of lubricating fluid passing into reservoir segment 60*a* may be maintained at a predetermined rate as desired. As shown, the metering valve 72 is recessed within the adapter sub housing 30.

Although the metering valve 72 may be completely removed in order to introduce lubricating fluid into the conduit 70 for the purpose of filling the storage cavity 68, it is preferred to provide a suitable fill plug or grease fitting 80 within the adapter sub housing 30 as shown. The fitting 80 may comprise, for example, a standard zerk-type fitting with a spring loaded check-valve (not shown) which would facilitate the filing of the storage cavity 68 with lubricating fluid and also prevent the lubricating fluid from flowing back out of the fitting 80.

In order to induce or promote the flow of lubricating fluid from the storage cavity 68 through the supply conduit 70 and into reservoir segment 60*a*, pressure means in the form of a free-floating piston 82 is disposed within the storage cavity 68 and having suitable sealing means to prevent fluid from leaking from one side of the piston to the other.

The piston 82 is free to move back and forth Within the storage cavity 68 under the influence of fluid pressure from either side. Thus, when lubricating fluid is pumped into the storage cavity 68 through the fitting 80, the lubricating fluid flows upwardly (toward the left on FIG. 3) through the supply conduit 70 and into the storage cavity 68. As the storage cavity 68 is filled, the force of the lubricating fluid acts upon the piston 82 and moves the piston 82 upwardly (toward the left as shown on FIG. 3) thereby expanding the storage cavity 68 to allow for the storage of additional lubricating fluid. In a similar manner, during the drilling operation, air pressure is applied to the lefthand side of the piston 82, forcing the piston 82 downwardly (toward the right as shown on FIG. 3), thereby forcing lubricating fluid to flow from the storage cavity 68 through the metering valve 72 in the supply conduit 70 and into reservoir portion 60*a*. The air pressure for causing the piston 82 to move downwardly within the supply cavity 68 during the drilling operation is provided by a generally cylindrical port 92 which extends into the cylindrical bore 40 from the upper (leftmost) end of the storage cavity 68. Since the port 92 is above the first orifice plate 42, the maximum pressure of air from the rotary drill controls the downward movement of the piston 82 to thereby provide a constant flow of lubricating fluid into reservoir segment 60*a*. As shown in FIG. 1, similar structures are provided at equally-spaced locations about the circumference of the adapter to assure a constant flow of lubricating fluid into the other two reservoir segments 60*b* and 60*c*.

Referring now to FIGS. 2 and 4, in the preferred embodiment, means is provided to direct air into the reservoirs 60*a*, 60*b* and 60*c* to mix with the oil and carry the lubricating fluid from a reservoir segment 60*a* to the cutting cone bearings 24. The means comprises a third conduit means 94 for receiving a third flow of pressurized air from the plenum chamber 50 and for directing the third air flow through the reservoir segment 60*a* and into the drill bit housing 18. A generally cylindrical distribution conduit 96 within the drill bit housing 18 provides fluid communication between reservoir segment 60*a* and the cutting cone bearings 24 so that the mixed lubricating fluid may flow from reservoir 60*a*, through the distribution conduit 96 and into contact with the cutting cone bearings 24 for the lubrication thereof. The pressure of the mixed lubricating fluid caused by the combined action of the piston 82 and the pressure in the conduit 94 serves to cause the mixed lubricating fluid to flow through the distribution conduit 96 to the cutting cone bearings 24. In the drawing, the distribution conduit 96 is in registry with the third conduit means 94. Thus, pressurized air from the plenum chamber 50 passes through the third conduit means 94 and into reservoir segment 60*a* where it is mixed with and picks up lubricating fluid. The resulting pressurized mixture of pressurized air and lubricating fluid passes through the distribution conduit 96 for the lubrication and cooling of cutting cone bearings 24. In addition, since the flow of air and lubricating fluid to the cutting cone bearings 24 is under pressure, the action of the pressurized air and lubricating fluid passing around the bearings 24 and between the cutting cone 22 and the underlying, supporting, housing structure prevents dust and debris from slipping around the sealing means (not shown) and in between the cutting cones 22 and the housing structure and from coming into contact with the cutting cone bearings 24, thereby keeping the bearings relatively clean, and extending their useful service life. As discussed above, similar structure (not shown) is employed to provde a flow of lubricating fluid and air to the other two cutting cones not shown.

As discussed briefly above, during a drilling operation, it is sometimes necessary to insert water or some other wetting agent into the air flowing from the rotary drill into the drill bit in order to control the dust generated by the drilling operation. As is also discussed above, the insertion of water into the prior art drill bits caused corrosion and premature wear of the cutting cone bearings. As shown on FIG. 2, air from the plenum chamber 50 enters the third conduit means 94 through a deflector entry port 98 which is positioned and oriented in such a manner that the flow of air must undergo a change of direction on the order of 110° prior to entry. During the drilling operation, the air must also move upwardly before entering the conduit 94 at the entry port 98. By forcing the air to undergo a change in direction in this manner prior to entering the third conduit 94, any water or other particles which may be borne by the air are separated from the air prior to its entry into the conduit 94. The separated water particles may pass downwardly and out of the plenum chamber 50 through the circular orifice 48 and out between the cutting cones 22. Thus, the air flowing through conduit 94 for the purpose of eventually cooling and lubricating the cutting cone bearings 24 remains relatively dry despite the addition of water to the pressurized air at the rotary drill.

As an alternative, the conduits 96 may all be fed from a continuous reservoir formed similarly to the reservoir segments 60*a*, 60*b* and 60*c*, but without the partitions 64. In such a case, only one oil injection assembly and only one air injection assembly may be needed to feed the continuous reservoir. The physical arrangement of conduits may then be simplified. To insure against reverse flow and contamination of the fluids by foreign particles in such cases, suitable check valves may be installed as needed.

From the foregoing description, it can be seen that the present invention provides an improved, longer life drill bit assembly having a plurality of rotary cutting cones for drilling into relatively hard material. The drill bit assembly also includes a means for continually cooling and lubricating the cutting cone bearings during the drilling operation. It will be recognized by those skilled in the art that changes may be made to the above-described embodiment without departing from the broad inventive concepts of the invention. It is understood, therefore, that this invention is not limited to the particular embodiment disclosed, but it is intended to cover all modifications which are within the scope and spirit of the invention as defined by the appended claims.

We claim:

1. A bit assembly for a rotary drill having a source of gaseous fluid under pressure, the bit having at least one rotary cutting cone for drilling into a hard material, the bit assembly comprising:

an elongated housing having a drill end adapted for engagement with the drill and the tool end for receiving a bit having at least one cutting cone for engaging the material to be drilled;

a plenum chamber within the housing for receiving a supply flow of the pressurized gaseous fluid from the fluid source;

pressure reducing means comprising a flow restricting orifice in the plenum chamber to provide a reduced pressure and reduced quantity of flow;

first conduit means in fluid communication with the flow restricting orifice for directing the reduced flow from the pressure reducing means out of the housing into the area of the cutting cone for impingement upon the material to pick up and remove dust and cuttings from the vicinity of the cutting cone;

second conduit means comprising at least one passage through the wall of the housing above the orifice and having a nozzle outlet positioned for discharging a flow of the pressurized gaseous fluid out of the housing remote from the cutting cone and toward the drill end of the housing;

the relative sizes of the flow restricting orifice and the nozzle outlet being such that the first gaseous fluid flow is sufficient in quantity and velocity for conveying the dust and, cuttings removed from the vicinity of the cutting cone into the second gaseous fluid flow, and the second fluid flow is of a high velocity from the nozzle outlet and a quantity sufficient to combine with the first fluid flow for conveying the dust and cuttings out of the drill hole.

2. The bit assembly as recited in claim 1 further including three rotary cutting cones.

3. The bit assembly as recited in claims 1 or 2 wherein the plenum chamber is positioned centrally within the elongated housing.

4. The bit assembly as recited in claims 1 or 2 wherein the housing is generally cylindrical having a bore defining said plenum chamber.

5. The bit assembly as recited in claims 1 or 2 wherein the gaseous fluid is air.

6. The bit assembly as recited in claims 1 or 2 wherein the second conduit includes jet nozzle means for concentrating and accelerating the second gaseous fluid flow discharged from the housing.

7. The bit assembly as recited in claim 2 wherein the reduced gaseous fluid flow is directed between the three cutting cones.

8. The bit assembly as recited in claim 2 wherein the cutting cones are supported on the housing by bearings, the bit further comprising:

storage means within the housing for receiving and storing a supply of lubricating fluid; and distribution conduit means extending between the storage means and each of the cutting cone bearings for permitting lubricating fluid to flow from the storage means to each of the cutting cone bearings.

9. The bit assembly as recited in claim 8 further including metering means for controlling the flow rate of the lubricating fluid flowing to the cutting cone bearings.

10. The bit assembly as recited in claims 8 or 9 wherein the storage means further includes pressure means for forcing lubricating fluid to flow under pressure from the storage means to the cutting cone bearings.

11. The bit assembly as recited in claim 10 wherein the storage means comprises a chamber and the pressure means comprises a two-sided piston disposed within the chamber, a first side of the piston confronting the supply of lubricating fluid within the cylindrical chamber and the second side of the piston confronting pressurized gaseous fluid, causing the piston to displace toward the lubricating fluid, thereby forcing lubricating fluid to flow out of the cylindrical chamber, through the distribution conduit means and into contact with the cutting cone bearings.

12. The bits assembly recited in claim 11 including means connecting said storage means to the said gaseous fluid source, so that the pressurized fluid contacting the second end of the piston is supplied by the gaseous fluid source.

13. The bit assembly as recited in claim 10 further including third conduit means extending from the plenum chanber to the distribution conduit means for receiving a third flow of gaseous fluid from the plenum chamber and for directing the third gaseous fluid flow through the distribution conduit means for impingement upon the cutting cone bearings.

14. A bit assembly for a rotary drill having a source of gaseous fluid under pressure, the bit assembly haivng at least one bearing-mounted rotary cutting cone for drilling into a hard material, the bit assembly comprising:

an elongated housing having a first end adapted for engagement with the drill and a second end including the at least one bearing mounted cutting cone, for engaging the material to be drilled;

a plenum chamber within the housing for receiving a supply flow of the pressurized gaseous fluid from the gaseous fluid source;

storage means within the housing for receiving and storing a supply of lubricating fluids;

distribution conduit means extending between the storage means and the cutting cone bearing for permitting lubricating fluid to flow from the storage means to the cutting cone bearing;

first conduit means communicating with the pressurized gaseous fluid flow in the plenum chamber and connected to the distribution conduit means for receiving a flow of gaseous fluid from the plenum chamber to be directed to the distribution conduit means; and means for combining the gaseous fluid from the first conduit means with the lubricating fluid within the distribution conduit.

15. The bit assembly as recited in claim 14 further including metering means for controlling the flow rate of the lubricating fluid to the cutting cone bearing.

16. The bit assembly as recited in claim 15 wherein the metering means comprises a valve disposed in the distribution circuit means within the housing for restricting the flow of lubricating fluid out of the storage means.

17. The bit assembly as recited in claim 14 wherein the storage means further includes pressure means for forcing lubricating fluid to flow under pressure from the storage means to the cutting cone bearing.

18. The bit assembly as recited in claim 17 further including second conduit means for providing fluid communication between the plenum chamber and the storage means to comprise said pressure means.

19. The bit assembly as recited in claim 18 wherein the storage means comprises a cylindrical chamber and the pressure means compirses a two-sided piston disposed within the cylindrical chamber, a first side of the piston confronting the supply of lubricating fluid within the cylindrical chamber and the second side of the piston confronting pressurized gaseous fluid from the plenum chamber, whereby upon activation of said source, the piston is displaced toward the lubricating fluid, thereby forcing lubricating fluid to flow out of the cylindrical chamber, through the distribution conduit means and into contact with the cutting cone bearing.

20. The bit assembly as recited in claim 18 further including pressure reducing means comprising a flow restricting orifice in the plenum chamber to reduce the flow of gaseous fluid, the second conduit means located upstream of the orifice and the first conduit means communicating with the reduced flow of pressurized gaseous fluid.

21. The bit assembly as recited in claim 14 wherein the first conduit means is positioned such that the pressurized gaseous fluid flowing in the plenum chamber must undergo a change of direction greater than 90° in entering the first conduit means.

22. The bit assembly as recited in claim 14 wherein said means for combining the gaseous fluid from the first conduit means with the lubricating fluid comprises reservoir means located within the distribution conduit means.

23. A bit assembly for a rotary drill having a source of gaseous fluid under pressure, the bit having at least one bearing-mounted rotary cutting cone for drilling into a material, the bit assembly comprising:

a housing having a drill end adapted for engagement with the drill and a tool end for receiving a bit having the at least one cutting cone, the at least one cutting cone being supported by bearings;

a plenum chamber within the housing for receiving a supply flow of pressurized gaseous fluid from the gaseous fluid source;

pressure reducing means comprising a flow restricting orifice within said plenum chamber to provide a reduced pressure and a reduced quantity of flow;

first conduit means in fluid communication with the flow restricting orifice for directing a first reduced gaseous fluid flow from the pressure reducing means out of the housing into the area of the cutting cone forimpingement upon the material to pick up and remove dust and cuttings from the vicinity of the cutting cone;

second conduit means comprising at least one passage through the wall of the housing and in fluid communication with the plenum chamber upstream from the flow restricting orifice for discharging a gaseous fluid flow of the pressurized gaseous fluid out of the housing remote from the cutting cone and toward the drill end of the housing, the relative sizes of the flow restricting orifice and the nozzle outlet being such that the first gaseous fluid flow is sufficient in quantity and velocity for conveying the dust and cuttings removed from the vicinity of the cutting cone into the second gaseous fluid flow, and the second fluid flow is of a high velocity from the nozzle outlet and of a quantity sufficient to combine with the first fluid flow for conveying the dust and cuttings out of the drill hole;

storage means within the housing for receiving and storing a supply of lubricating fluid;

distribution conduit means extending between the storage means and the bearings of the at least one cutting cone for permitting lubricating fluid to flow from the storage means to the cutting cone bearings;

third conduit means extending from the plenum chamber to the distribution conduit means for receiving a flow of gaseous fluid from the plenum chamber; and means for combining the flow of gaseous fluid from the said third conduit means with the lubricating fluid to provide a gaseous fluid and lubricating fluid mixture in the distribution conduit means conveyed to the bearings of the cutting cone.

24. The bit assembly as recited in claim: 23 wherein the means for combining the gaseous fluid from the third conduit means with said lubricating fluid comprises a reservoir means located within the distribution conduit means.

25. The bit assembly as recited in claim 24 wherein the reservoir means comprises an annular conduit extending around the first end of the housing.

26. The bit assembly as recited in claim 25 and further including partition means for dividing the annular reservoir conduit into a plurality of arcuate reservoir segments, one reservoir segment for each cutter, said distribution conduit means comprising a separate conduit for each cutter extending from one of said segments to the bearing means for the associated cutter.

27. The bit assembly as recited in claims 25 or 26 wherein the annular reservoir conduit comprises an annular groove cut within a survace of the first end of the housing which engages the adapter subassembly, said groove being closed by the adapter subassembly to form the reservoir means when said housing and subassembly are in supportive engagement.

28. A bit assembly for a rotary drill having a source of gaseous fluid under pressure, the bit assembly comprising:

a housing having an end adapted for engagement with the drill and a tool end for connection to a drill bit;

a drill bit connected to the tool end of the housing end having at least one cutting cone supported by bearings in the bit;

a plenum chamber within the housing for receiving a supply flow of presurized gaseous fluid from the gaseous fluid source, the bit having a bit conduit communicating with the plenum chamber and providing a continuation thereof;

pressure reducing means comprising a flow restricting orifice within said plenum chamber to reduce the pressurized gaseous fluid flow;

the bit conduit receiving the reduced flow for impingement upon the material in the area of the cutting cone to pick up and remove dust and cuttings from the vicinity of the cutting cone;

storage means within the housing for receiving and storing a supply of lubricating fluid and having pressure means for forcing the lubricating fluid from the storage means;

distribution conduit means extending between the storage means and the bearings of the at least one cutting cone for permitting lubricating fluid to flow from the storage means to the cutting cone bearings;

first conduit means upstream of the flow restricting orifice for providing fluid communication between the pressurized gaseous fluid in the plenum chamber and the storage means for receiving the pressurized gaseous fluid to comprise the pressure means for the storage means;

second conduit means downstream of the flow restricting orifice communication with the reduced flow in the plenum chamber and connected to the distribution conduit means for receiving a flow of the gaseous fluid from the plenum chamber to be directed to the distribution conduit means;

means for combining the flow of gaseous fluid from the second conduit means with the lubricating fluid to provide a gaseous fluid and lubricating fluid mixture in the distribution conduit means conveyed to the bearings of the cutting cone.

29. The bit assembly as recited in claim 28 further including third conduit means in fluid communication with the plenum chamber and having a nozzle outlet for discharging a gaseous fluid flow of the reduced Pressure gaseous fluid out of the housing remote from the cutting cone and toward the drill end of the housing for conveying the dust and cuttings removed from the vicinity of the cutting cone and toward the drill end of the housing.

* * * * *